US012735834B2

(12) United States Patent
Reid

(10) Patent No.: US 12,735,834 B2
(45) Date of Patent: Sep. 15, 2026

(54) SOCK FASTENING DEVICE

(71) Applicant: Andrea Elena Reid, Moseley, VA (US)

(72) Inventor: Andrea Elena Reid, Moseley, VA (US)

( * ) Notice: Subject to any disclaimer, the term of this patent is extended or adjusted under 35 U.S.C. 154(b) by 237 days.

(21) Appl. No.: 18/444,718

(22) Filed: Feb. 18, 2024

(65) Prior Publication Data

US 2024/0271358 A1 Aug. 15, 2024

Related U.S. Application Data

(60) Provisional application No. 63/487,967, filed on Mar. 2, 2023.

(51) Int. Cl.
*D06F 95/00* (2006.01)

(52) U.S. Cl.
CPC ..... *D06F 95/008* (2013.01)

(58) Field of Classification Search
CPC ..... D06F 95/0078
See application file for complete search history.

(56) References Cited

U.S. PATENT DOCUMENTS

2016/0278440 A1* 9/2016 Kaspi ..... A41B 11/002

* cited by examiner

*Primary Examiner* — Jason Y Ko

(57) ABSTRACT

A device with a loop fastener that links a pair, or more, of socks, by being opened; threaded through holes in each sock; and closed, such that the sock pairs are kept together before, during and after the laundering process. The device reduces the amount of time needed to do laundry by eliminating the need to sort and fold sock pairs and eliminates the risk of losing one mate in a pair of socks.

14 Claims, 5 Drawing Sheets

SOCK FASTENING DEVICE

BACKGROUND OF THE INVENTION

1. Field of the Invention

The present application relates generally to the field of fasteners for apparel. To be more specific, the embodiments of this invention disclose socks with a hole and loop fastener to releasably engage a pair of socks to one another.

2. Statement of the Problem

Socks and some other articles of clothing, are products that are meant to be worn in pairs but encounter problems during laundering and sorting. Because they are small and lightweight, socks frequently become lost from being "sucked up" inside the washer or dryer, misplaced inside a sock drawer and/or stuck to another article of clothing, rendering the sock pair essentially useless as they are unable to be worn as intended pairs.

Furthermore, socks almost always become separated from one another during laundering, making pairing them back together burdensome and time-consuming. Particularly in settings where a large number of socks are being washed and dried together, as in households with small children and many family members, hospitals or nursing homes, an enormous amount of time can be wasted searching for the mate to a sock, mitten, or glove. If the mate is not found, the other member of the pair generally must be discarded. Matching pairs of socks in these settings is even more difficult and time-consuming where socks are a variety of colors and fabrics that can appear similar to one another under normal lighting conditions but are not identical and therefore cannot be paired together.

3. Description of the Prior Art

Numerous inventions have been created to try to resolve this problem, all of which are acceptable for securing garments in some fashion, but pose their own problems that the present invention resolves, as discussed further below. The prior art is described below in chronological order to show advancement in the art, and which are incorporated herein by reference thereto. Even though these innovations may be suitable for the specific individual purposes to which they address, they differ from the present invention in that they do not permit full laundering of the sock pairs and preserve the sock during the laundering process.

The prior art in this field includes the following:

| Inventor | U.S. Pat. No. | Issue Date |
|---|---|---|
| Bohman | 2,663,877 | Dec. 29, 1953 |
| Burandt | 2,710,409 | Jun. 14, 1955 |
| Rabinowitz | 3,414,944 | Dec. 10, 1968 |
| Hofmeister | 3,699,617 | Oct. 24, 1972 |
| Boxer et al. | 4,058,853 | Nov. 22, 1977 |
| Strongwater | 4,975,986 | Dec. 11, 1990 |
| Ursino | 5,038,413 | Aug. 13, 1991 |
| Ciuffo | 5,321,855 | Jun. 21, 1994 |
| Ross | 5,367,809 | Nov. 29, 1994 |
| Hicks | 5,450,658 | Sep. 19, 1995 |
| Christy et al. | 5,579,541 | Dec. 3, 1996 |
| Messman | 5,740,558 | Apr. 21, 1998 |
| Jones | 5,918,318 | Jul. 6, 1999 |
| Becker et al. | 5,970,524 | Oct. 26, 1999 |
| Stubbs | 5,974,590 | Nov. 2, 1999 |

-continued

| Inventor | U.S. Pat. No. | Issue Date |
|---|---|---|
| Dean | 6,032,294 | Mar. 7, 2000 |
| Mason | 6,185,751 | Feb. 13, 2001 |
| Pietzyk-Hardy | 7,058,986 | Jun. 13, 2006 |

(1) U.S. Pat. No. 5,038,413 to Ursino.

U.S. Pat. No. 5,038,413 issued to Ursino on Aug. 13, 1991, teaches a fastening device for securing a pair of socks together. It includes a first fastener attached to one sock of the pair and a second fastener attached to the other sock of the pair, which are releasably engage able with one another. This invention, like the present invention, prevents the loss of socks due to separation from one another and the inconsistent pairing of socks of a similar type. However, it presents issues of comfort and damage to the sock because of the way the fasteners are permanently attached to the sock, as discussed below.

(2) U.S. Pat. No. 5,321,855 to Ciuffo.

U.S. Pat. No. 5,321,855 issued to Ciuffo on Jun. 21, 1994, teaches a hook and loop reusable and reclosable fastening system for pairing socks, hosiery, and gloves which is permanently attached to the socks and hosiery. A preferred embodiment includes a stretchable backing material, attached to each hook and loop panel, preferably, made up of thin separable strips that can move with the expansion and contraction of the sock and attachment material.

Although this prior art is useful in that it pairs together apparel pairs, the hook and loop fastening system is attached to the articles of clothing, which may present an unattractive appearance and/or affect the comfort of the wearer. The present invention involves embroidered holes in the socks which are small and unobtrusive. They do not negatively affect the appearance of the sock. The holes may be embellished with decorations surrounding them for a more attractive appearance, and the threading used to create the embroidered eyelet holes may be a color similar to the sock, therefore camouflaging it.

(3) U.S. Pat. No. 6,032,294 to Dean.

U.S. Pat. No. 6,032,294 issued to Dean on Mar. 7, 2000, teaches a sock pair or glove pair having a first and a second sock or glove and snap fasteners on each sock or glove. Each fastener has a male part, a female part, and two securing parts.

(4) U.S. Pat. No. 6,185,751 to Mason.

U.S. Pat. No. 6,185,751 issued to Mason on Feb. 13, 2001, teaches a device for attaching articles of clothing together. It uses paired fasteners on each of the two articles of clothing that can be attached together which allows the two articles to either be attached together or turned inside out and folded upon themselves and attached to themselves.

Although this prior art acts to pair socks together, because the snap fasteners are attached directly to the socks, there exists the very real danger of the socks being stretched and pulling away from one another during the wash/dry cycle. Because of the delicacy of most sock fabrics, such as cotton, the snap fasteners may consequence act to rip and tear the socks while they're snapped together. Furthermore, the snaps, most likely made of plastic or metal, may be uncomfortable.

The present invention does not present the danger of damaging the sock pairs, as the loop fastener moves freely through the embroidered holes, which are reinforced by the eyelet thread to add protection to the sock. Furthermore, the embroidered thread is made of materials similar to the sock fabric, like cotton and bamboo, and therefore cannot be felt by the wearer.

(5) U.S. Pat. No. 7,058,986

U.S. Pat. No. 7,058,986 issued to Pietzyk-Hardy on Apr. 14, 2005, teaches a device for fastening socks using snap fasteners. One male part is attached to one sock, and one female part is attached to the other sock, which makes the pair able to be snapped together for laundering and pairing. This invention, though it pairs socks together, presents the same issues as Mason's invention, above, namely, the probability of the socks becoming damaged during laundering, and discomfort to the wearer. The present invention, as discussed above, resolves these issues.

It is apparent that numerous innovations for fasteners for pairing garments utilized in pairs have been provided in the prior art that are adapted to be used. Even though these innovations may be suitable for the specific individual purposes to which they address, there are problems that arise in each which are all resolved in the present invention as heretofore described, namely, a fastening device for socks.

4. Solution to the Problem

In contrast to the prior art of Pietzyk-Hardy, Dean, Mason, Ursino, and Ciuffo, the present invention provides a means by which socks and other articles of apparel can be laundered completely. More specifically, other fastening devices do not permit full laundering of the socks, as the clasping together of the socks covers part of them, leaving these sections still soiled after being washed and dried. The present invention permits full laundering of both socks, because the loop fastener moves freely through the embroidered holes, serving to fasten them together but also move freely along the loop fastener during the wash/dry cycle.

Furthermore, in the prior art of Dean, Ursino, Messman, Bohman, Stubbs, Hofmeister, Pietzyk-Hardy and Becker, et al., fastening devices may damage or tear the sock, leaving them unable to be worn. While inventions of these prior art do fasten socks together, the manner in which they are fastened causes the socks to pull during the laundering process, increasing the likelihood of them being damaged during the wash/dry cycle. The fasteners which are permanently attached to the sock can tear off of the sock, damaging the sock. The present invention features embroidered holes, the eyelet threading of which serves to reinforce the sock fabric against wear and tear of the loop fastener, preserving their form during laundering and leaving it highly unlikely that the sock will tear or rip.

Ursino, Messman, Bohman, Stubbs, Hofmeister and Becker, et al., disclose a variety of snap fasteners for removably securing sock pairs together. Burandt and Strongwater disclose snap fasteners to removably secure a pair of gloves together. Hicks discloses magnetic fasteners to removably secure a pair of socks together. Christy, et al., Boxer, et al., Ciuffoo, and Jones all disclose a variety of hook and loop fasteners for removably securing a pair of socks together. However, in each case, the fastener or some sort of cover remains visible when the socks are being worn. The visibility and bulkiness of these exterior devices on the socks is problematic for several different demographic groups. For athletes wishing to reduce drag on their socks, this creates a problem, as the exterior device may weigh them down while training. For children or those individuals with sensitive skin, these fasteners that stick out may be itchy and/or hurt their feet or ankles. For all groups and individuals, any fastener that sticks out of the sock, as in these prior art, may press against the foot and ankle while wearing shoes, making them very uncomfortable.

In the present invention, sock holes may be visible, but they may feature ornamental additions to enhance the appearance of the sock. Additionally, the means by which the socks are fastened in the present invention are not felt by the sock wearer, as they are made of thread similar to the fabric, such as cotton or bamboo, of the socks themselves. They are soft and unable to be felt or differentiated from the sock itself by the wearer. Fasteners in the prior art which are secured to the sock and not able or meant to be removed and are therefore very burdensome and uncomfortable in this regard.

Finally, many of the sock fastening devices in the prior art include fasteners with male and female parts, forcing the sock with the male part to be joined to the sock with the female part. If one of the socks in these pairs becomes lost or unwearable, the remaining sock will no longer be able to be fastened to another sock unless a sock is bought or found that has the appropriate gender of the fastener to which it can be mated. The present invention does not present these issues, as all of the embroidered holes are identical in the socks, allowing one sock to replace another, where one is lost or becomes unwearable.

None of the above inventions and patents, taken either singly or in combination, is seen to describe the instant invention as claimed.

SUMMARY

By providing a device that secures two socks together by the disclosed embodiments, the risk of losing socks during the laundering process is reduced, and the likelihood of sock pairs staying together during the laundering process is increased, eliminating the need for sock sorting.

The disclosed exemplary embodiments provide a device in which at least two socks may be linked together in pairs or groups, through threading a loop fastener through reinforced holes located in the socks, such that said socks stay together before, during and after the laundering process.

In one embodiment, the loop fastener is threaded through one embroidered hole in one sock and one embroidered hole in its corresponding sock pair, and fastened together with a clasp.

In another embodiment, the loop fastener is threaded through one embroidered hole in one sock and one embroidered hole in its corresponding sock pair, and fastened together with a magnet.

Further features, objects, properties and advantages of the device according to the present application will become apparent from the detailed description.

BRIEF DESCRIPTION OF THE DRAWINGS

In the following detailed portion of the present description, the teachings of the present application will be explained in more detail with reference to the example embodiments shown in the drawings, in which.

204*b* of the two socks 202*a* and 202*b* with the loop fastener 100 threaded through embroidered eyelet holes 203*a* and 203*b* of both socks 202*a* and 202*b*, of the sock pair 200, with the clasp 101 left un-fastened.

Figure 4:
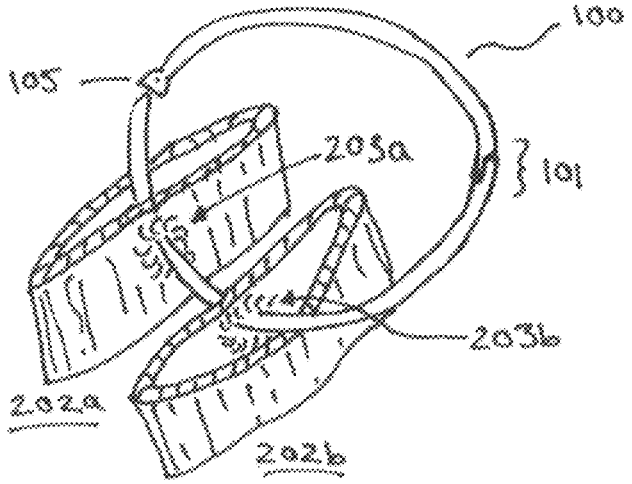

FIG. 4 is a perspective view of the first embodiment of the present invention, featuring the ankle portions 204*a* and 204*b* of the two socks 202*a* and 202*b* with the loop fastener 100 threaded through the embroidered eyelet holes 203*a* and 203*b* of both socks 202*a* and 202*b* and fastened with the clasp 101.

Figure 5:
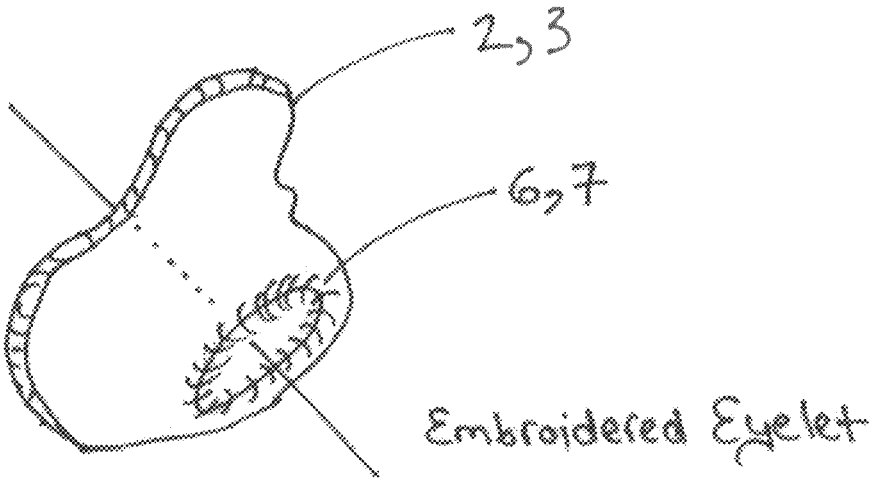
Figure 5:
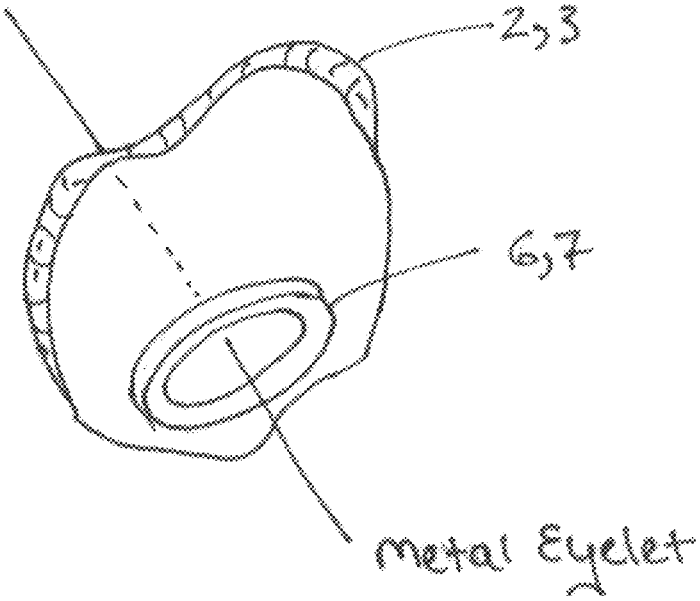

FIG. 5 is a detail exploded perspective view showing the assembly of the embroidered eyelet hole 203*a* and the ankle of the sock 204*a*.

Figure 6:
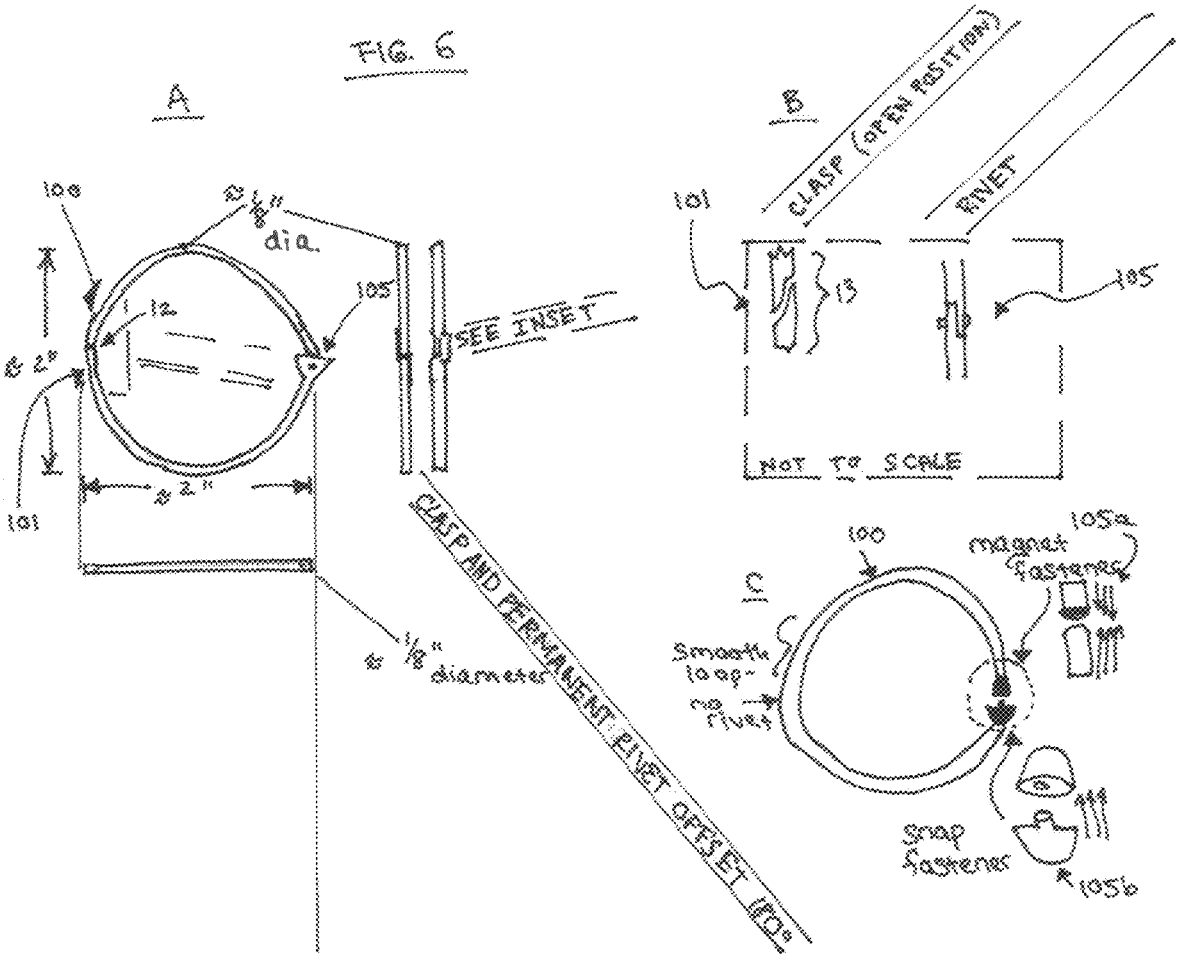

FIG. 6 is detail perspective view of the loop fastener 100 showing the clasp portion 101 in a closed position 12 and an open position 13 and attached permanent rivet 105.

Figure 7:
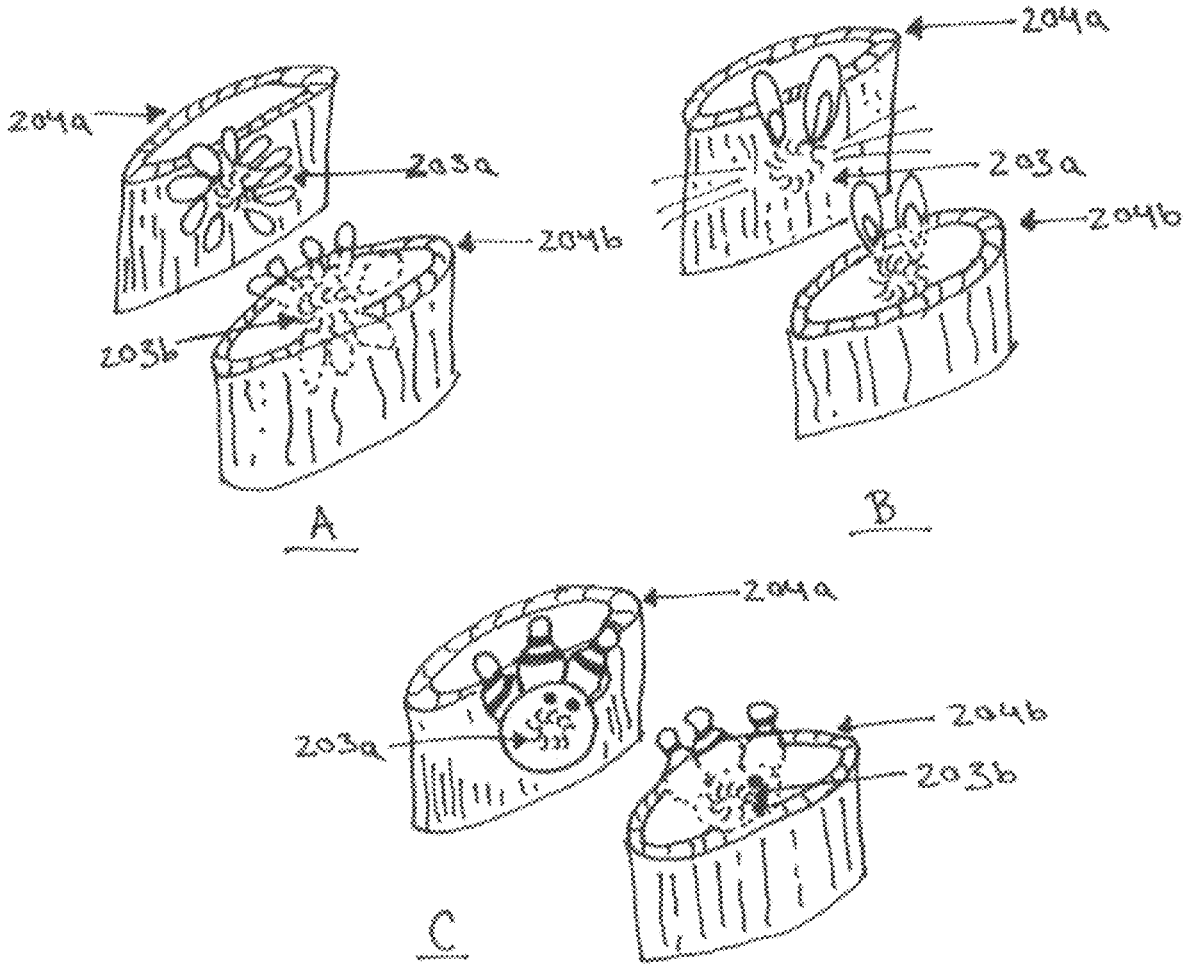

FIG. 7 is a perspective view of a second embodiment of the present invention.

DETAILED DESCRIPTION

In the following detailed description, the device according to the teachings for this application in the form of a sock fastening device will be described by the embodiments. It should be noted, that although only socks are described, the teachings of this application can also be used for other pieces of clothing that might require fastening together because they are worn in pairs, such as gloves, mittens, bra/panty sets, shirt/pant sets, or for joining clothing by individual for ease of sorting where multiple individuals are sharing a washer and dryer.

Figure 1:
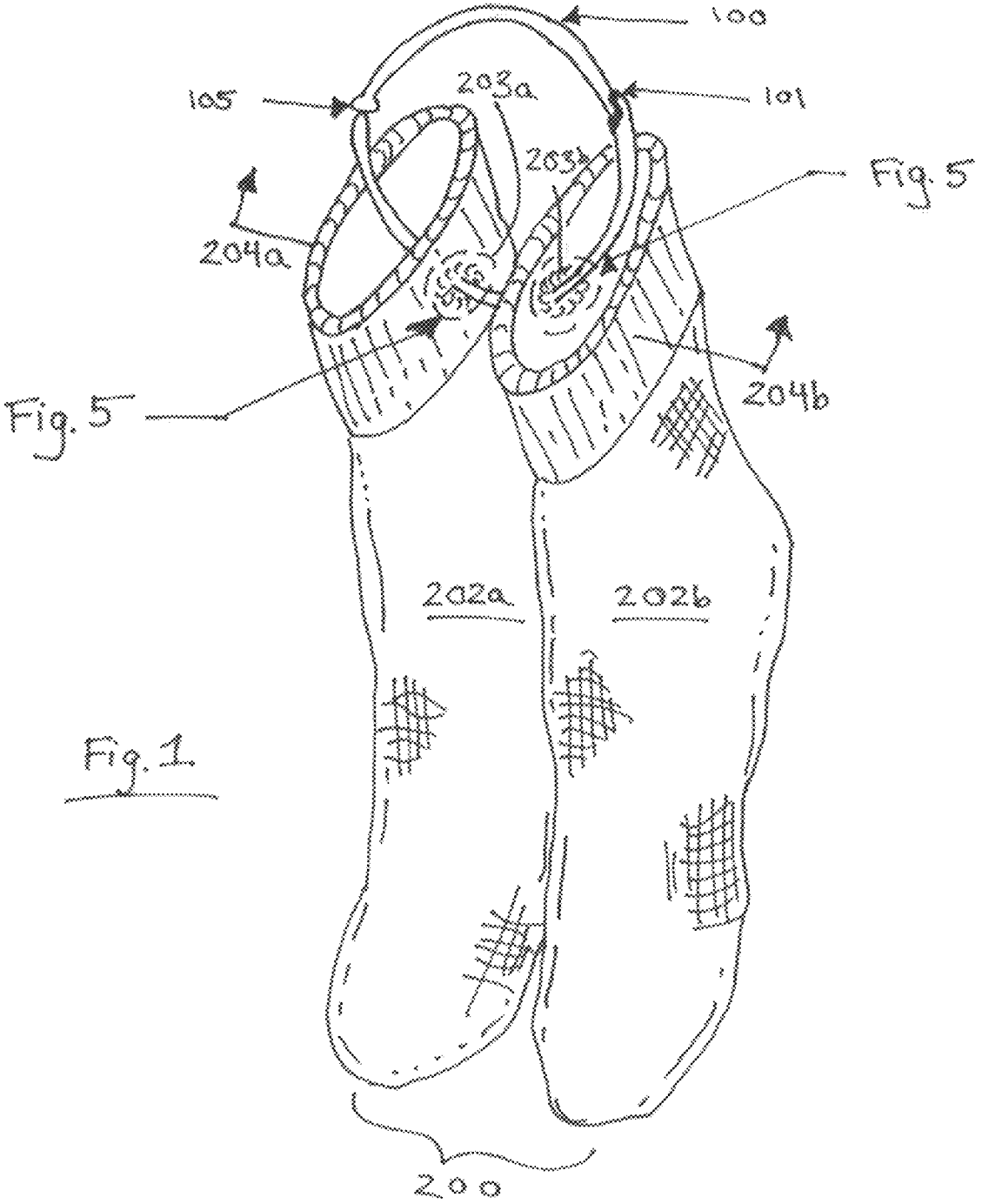
FIG. 1 is a perspective view of one embodiment of the present invention.

A first embodiment of the sock fastening device in the perspective view is illustrated in FIG. 1. The sock fastening device 200 comprises a pair of socks 200 with each of socks 202*a* and 202*b* equipped with one eyelet hole 203*a* and 203*b* located in the ankle sections 204*a* and 204*b* of each of socks 202*a* and 202*b*, and reinforced by means of embroidered threading fashioned in an eyelet sewing style. Optionally, the eyelet holes can be reinforced by metal eyelets as illustrated in the cross-sectional view in FIG. 5.

Figure 2:
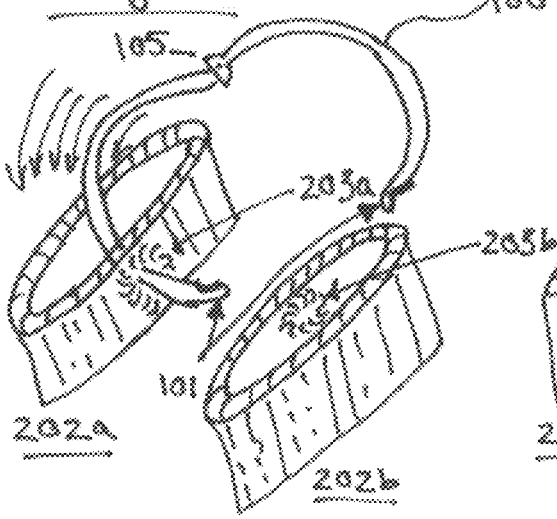
FIG. 2 is a perspective view of the first embodiment of the present invention, featuring the ankle portions 204*a* and 204*b* of the two socks 202*a* and 202*b* with the loop fastener 100 un-fastened and threaded through the embroidered eyelet hole 203*a* of the first sock 202*a* of the sock pair 200.

Prior to putting the socks 202*a* and 202*b* on a wearer's feet, the wearer would typically open the clasp 101 to the loop fastener 100 by exerting applied force on each of two sides of the loop fastener 100 to pull the loop fastener apart, as shown in part, in FIG. 2, with a bend at the rivet and an opening near the clasp 101. This allows the loop fastener 100 to be opened, allowing the socks 202*a* and 202*b* to be removed from the loop fastener 100 to be worn.

After the loop fastener 100 is opened, the wearer can remove socks 202*a* and 202*b* from the loop fastener 100 by sliding the socks 202*a* and 202*b* off the loop fastener 100. This is done by moving each sock 202*a* and 202*b*, either one at a time, or both together, in a clockwise fashion along the loop fastener 100, with the loop fastener 100 moving through and off the sock 202*a* and 202*b*'s embroidered eyelet holes 203*a* and 203*b*, away from the rivet, until the sock is completely off the loop fastener 100. The loop fastener 100 then may be left and retained in the laundry room, sock, drawer, or where convenient for the wearer, to be used when the socks 202*a* and 202*b* become dirty and need to be again fastened to be laundered.

Figure 3:
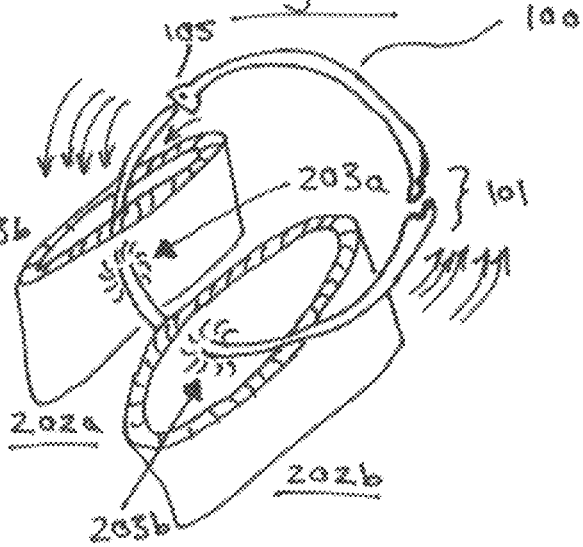
FIG. 3 is a perspective view of the first embodiment of the present invention, featuring the ankle portions 204*a*.

After the socks 202*a* and 202*b* have been worn and are ready to be laundered, the wearer removes the socks 202*a* and 202*b* and locates the loop fastener 100 in preparedness to fasten together the socks for laundering. The socks 202*a* and 202*b* are then slid onto the loop fastener 100 by opening the loop fastener 100 by exerting applied force, holding onto each side of the loop and pulling outward, until the clasp 101 is opened. As illustrated in FIG. 2, the loop fastener is then threaded through embroidered eyelet hole 203*a* of sock 202*a*, until the sock is securely onto the loop. As illustrated in FIG. 3, the loop fastener 100 is then threaded through embroidered eyelet hole 203*b* in sock 202*b*. As illustrated in FIG. 4, the clasp 101 is then closed by exerting applied force onto either side of the loop fastener 100, pushing each side of the loop together until the clasp 101 "clicks." Optionally, the loop fastener may be closed together by other means, such as a magnet, as illustrated in FIG. 6. The socks are then ready to be washed, dried, sorted and stored in this fashion, with the socks 202*a* and 202*b* securely fastened by their embroidered eyelet holes 203*a* and 203*b* to the loop fastener 100 with clasp 101.

FIG. 5 is a detail exploded perspective view of one of the embroidered eyelet holes 203*a* of sock 202*a*, showing assembly of the embroidered thread, which lines, in an eyelet style, and subsequently acts to reinforce the hole 203*a* in the ankle portion 204*a* of the sock 202*a*. Reinforcement of the hole is essential in order to prevent the loop fastener 100 from tearing and pulling at the sock 202*a* during laundering. This picture is identical in all respects to the embroidered eyelet hole 203*b* of sock 202*b*, except that they reside on different socks. Embroidered eyelet holes are the preferred embodiment of the present invention 200, because embroidered thread is soft, much like the fabric of the sock itself. Therefore, using a hole using this thread should not be felt by the wearer. However, another embodiment of the present invention may use other materials to create holes 203*a* and 203*b*, such as metal eyelet holes, which are nicely reinforced in the sock, as also illustrated in FIG. 5.

FIG. 6 is a detail perspective view of several embodiments of the loop fastening device 100. Part A presents a detailed perspective view of the approximate size and appearance of the loop of the preferred embodiment of the loop fastener that includes a clasp 101 and rivet 105. It should be noted that the detail in FIG. 6 is approximate; the loop may be of different sizes, with a size that is big enough to allow the loop to be threaded through both sock holes 203*a* and 203*b*, yet small enough that it's not impractical and/or cumbersome for the wearer to use. Part B presents a detailed perspective view of the clasp and rivet sections of the loop fastener.

Part C details another set of embodiments for the loop fastener 100 that include different methods of fastening the loop and do not include a rivet. The fastening part of the loop fastener 100 in these embodiments can be accomplished by a magnet fastener 105*a* or a snap fastener 105*b*, as opposed to a clasp 105, as described in the preferred embodiment (Parts A and B). The magnet fastener 105*a* includes a positive magnet on one side of the loop fastener and a negative magnet on the other side of the loop fastener, such that the fastener closes when the two sides are pushed together by applied force. The snap fastener 105*b* includes a male snap part on one side of the loop fastener opening and a female snap fastener on the other side of the loop fastener opening, such that the loop fastener snaps closed when the two ends are pushed together with applied force. All embodiments of the loop fastener 100 are made of rust-proof and fire-proof material, such as rust-proof metal, silicone, or plastic, so as to withstand multiple wash and dry cycles.

FIG. 7 is a perspective view of another embodiment of the present invention. This embodiment is virtually identical to the first embodiment, except it adds ornamentation around both embroidered eyelet holes 203*a* and 203*b*. The purpose of adding such decoration is to enhance the appearance of the sock fastening device 100 and to serve as a useful way to "target" the holes through which the loop fastener may be threaded. This feature may be especially useful for socks where the wearer is a child.

Part A is a perspective view of embroidered eyelet holes 203*a* and 203*b* located in the ankle portions 204*a* and 204*b* of each sock. In this embodiment, the eyelet holes 203*a* and 203*b* resemble the discs of a daisy, surrounded by fabric petals. Part B is a perspective view of embroidered eyelet holes 203*a* and 203*b* located in the ankle portions 204*a* and 204*b* of each sock. In this embodiment, the eyelet holes 203*s* and 203*b* resemble the heads of bunnies, with two fabric ears protruding from the top of each "head" and black fabric "whiskers" protruding from the sides of the eyelet hole "heads." Part C is a perspective view of embroidered holes 203*a* and 203*b* located in the ankle portions 204*a* and 204*b* of each sock. In this embodiment, a fabric disc bowling ball with three pins is attached in a fashion onto the socks such that the embroidered holes 203*a* and 203*b* resemble one hole of the three contained in a bowling ball. Although daisies, bunnies and bowling balls are described in the present embodiments, the type of ornamentation that surrounds the embroidered eyelet holes are not limited to these specific decorations.

The various aspects of what is described above can be used alone or in various combinations. It should be noted that the teaching of this application is not limited to the use with socks and gloves, but can be equally well applied to mittens, bra/panty sets, or the like.

The teaching of the present application has numerous advantages. Different embodiments or implementations may yield one or more of the following advantages. It should be noted that this is not an exhaustive list and there may be other advantages which are not described herein. For example, one advantage of the teaching of this application is it provides for a device that ensures sock pairs, multiple pairs of socks of the same owner, glove/mitten pairs and the like stay paired together while thrown into the washing machine and then into the dryer.

It is another advantage of the present invention in that it provides for sock pairs to stay paired together after laundering so that no sorting to locate sock pairs is necessary. It is yet another advantage of the present invention that because the socks are paired together with a bulky loop, no one sock will get lost (i.e., sucked up) into the washer or dryer.

These advantages, taken together, are superior than prior art in this field, in that the way the loop fastener works to fasten the sock pair together does not prevent them from becoming fully laundered, as is the case where snap fasteners and/or clamps cover part of the sock during laundering. Furthermore, the reinforced holes prevent wear and tear on the sock during laundering, which solves problems in the prior art, where fasteners that are attached to the sock may pull at the sock during laundering, therefore damaging it.

The above disclosure sets forth a number of embodiments of the present invention described in detail with respect to the accompanying drawings.

Those skilled in this art will appreciate that various changes, modifications, other structural arrangements, and other embodiments could be practiced under the teachings of the present invention without departing from the scope of the invention as set forth in the attached claims.

The invention claimed is:

1. A sock fastener comprising:

a unitary body formed of a flexible silicone material;

a loop portion configured to extend through openings in a pair of socks; and an integrally formed releasable fastening mechanism configured to secure the loop portion in a closed loop configuration;

wherein the unitary body is configured to remain attached to the socks during washing, drying, and wearing.

2. The sock fastener, according to claim 1, wherein each of the openings in the pair of socks includes a reinforcement structure comprising embroidered stitching.

3. The sock fastener of claim 2, wherein each hole has a diameter between 5 mm and 10 mm, sized to permit passage of the loop portion while maintaining structural integrity of the sock.

4. The sock fastener of claim 2, wherein each hole is positioned in an inner ankle region of the sock to reduce visibility during wear.

5. The sock fastener of claim 1, wherein the loop portion and releasable fastening mechanism are formed integrally as a single unit from flexible silicone material.

6. The sock fastener of claim 5, wherein the loop portion has a thickness between 3 mm and 5 mm, sufficient to permit repeated laundering without structural failure.

7. The sock fastener of claim 5, wherein the releasable fastening mechanism comprises an integrally formed protrusion and corresponding receiving aperture.

8. The sock fastener of claim 7, wherein the protrusion is resiliently deformable to permit repeated engagement and disengagement.

9. The sock fastener of claim 1, wherein the loop portion is configured to extend through aligned holes in a pair of socks such that the socks are retained on the loop.

10. The sock fastener of claim 9, wherein the socks are movable along the loop portion while remaining secured thereto.

11. The sock fastener of claim 9, wherein the socks are retained in a substantially flat orientation when fastened together.

12. The sock fastener of claim 1, wherein the device is configured to remain attached to the socks during washing, drying, sorting, and storage without removal.

13. The sock fastener of claim 1, wherein the unitary body is formed entirely of silicone, and comprises a releasable fastening mechanism having a protrusion and corresponding aperture, and wherein the unitary body is configured to remain attached to the socks during washing, drying, and wearing such that the device remains visible when the socks are worn.

14. The sock fastener of claim 1, wherein the openings in the socks comprise embroidered eyelets having ornamental features.

* * * * *